US010488772B2

(12) United States Patent
Yaoi et al.

(10) Patent No.: US 10,488,772 B2
(45) Date of Patent: Nov. 26, 2019

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Shinichi Yaoi, Kanagawa (JP); Asafumi Fujita, Kanagawa (JP); Yasushige Nakamura, Kanagawa (JP); Seijiro Ishimaru, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/666,943

(22) Filed: Aug. 2, 2017

(65) Prior Publication Data

US 2018/0095373 A1 Apr. 5, 2018

(30) Foreign Application Priority Data

Oct. 5, 2016 (JP) ..... 2016-197506

(51) Int. Cl.
*G03G 9/087* (2006.01)
*G03G 9/08* (2006.01)
*G03G 15/08* (2006.01)

(52) U.S. Cl.
CPC ..... *G03G 9/08755* (2013.01); *G03G 9/0819* (2013.01); *G03G 9/0821* (2013.01); *G03G 9/0827* (2013.01); *G03G 15/0867* (2013.01)

(58) Field of Classification Search
CPC ..... G03G 9/08755
See application file for complete search history.

(56) References Cited

U.S. PATENT DOCUMENTS 8,628,900 B2 * 1/2014 Kadokura ..... G03G 15/0806 430/105
9,134,637 B2 * 9/2015 Hotta ..... G03G 9/08755
9,176,408 B2 * 11/2015 Kadokura ..... G03G 9/0819
2006/0222991 A1 * 10/2006 Sacripante ..... G03G 9/0804 430/109.4
2010/0196817 A1 * 8/2010 Sasaki ..... G03G 9/0819 430/109.4
2017/0003613 A1 * 1/2017 Kida ..... G03G 9/09708

FOREIGN PATENT DOCUMENTS

JP 2001-330989 * 11/2001 ..... G03G 9/087
JP 2010-139937 A 6/2010
JP 2011186206 * 9/2011 ..... G03G 9/087
JP 2014-178528 A 9/2014

OTHER PUBLICATIONS

Machine English language translation of JP 2011186206 Sep. 2011.*
Translation of JP 2001-330989.*

* cited by examiner

*Primary Examiner* — Peter L Vajda
(74) *Attorney, Agent, or Firm* — Oliff PLC

(57) ABSTRACT

An electrostatic-image developing toner contains toner particles containing a polycondensate resin and hydrophobic external additive particles having a volume average particle size of about 40 to about 200 nm. The electrostatic-image developing toner has a difference between a half-fall temperature T1/2A and a half-fall temperature T1/2B of about 2.0° C. to about 10° C. The half-fall temperature T1/2A is measured with a flow tester after storage in an environment at 50° C. and an absolute humidity of 16.5 g/m$^3$ for 2 hours. The half-fall temperature T1/2B is measured with a flow tester after storage in an environment at 50° C. and an absolute humidity of 82.7 g/m$^3$ for 2 hours.

17 Claims, 2 Drawing Sheets

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2016-197506 filed Oct. 5, 2016.

BACKGROUND (i) Technical Field

The present invention relates to electrostatic-image developing toners, electrostatic image developers, and toner cartridges.

(ii) Related Art

Techniques for forming visible images based on image information via electrostatic images, such as electrophotography, are currently used in various fields. In electrophotography, an electrostatic image (electrostatic latent image) is formed on a photoreceptor (image carrier) by charging and exposure steps and is then developed with a developer containing a toner, followed by transfer and fixing steps to form a visible image. Developers for use in electrophotography include two-component developers, which are composed of a toner and a carrier, and one-component developers, which are composed only of a magnetic or nonmagnetic toner. A typical toner manufacturing process is pulverization, in which a thermoplastic resin is melt-mixed with a pigment, a charge control agent, and a release agent such as wax and is then cooled, pulverized, and classified. To improve the chargeability of the toner, inorganic or organic particles are optionally added to the surfaces of the toner particles.

SUMMARY

According to an aspect of the invention, there is provided an electrostatic-image developing toner containing toner particles containing a polycondensate resin and hydrophobic external additive particles having a volume average particle size of about 40 to about 200 nm. The electrostatic-image developing toner has a difference between a half-fall temperature T1/2A and a half-fall temperature T1/2B of about 2.0° C. to about 10° C. The half-fall temperature T1/2A is measured with a flow tester after storage in an environment at 50° C. and an absolute humidity of 16.5 g/m$^3$ for 2 hours. The half-fall temperature T1/2B is measured with a flow tester after storage in an environment at 50° C. and an absolute humidity of 82.7 g/m$^3$ for 2 hours.

BRIEF DESCRIPTION OF THE DRAWINGS

An exemplary embodiment of the present invention will be described in detail based on the following figures, wherein.

DETAILED DESCRIPTION

Figure 1:
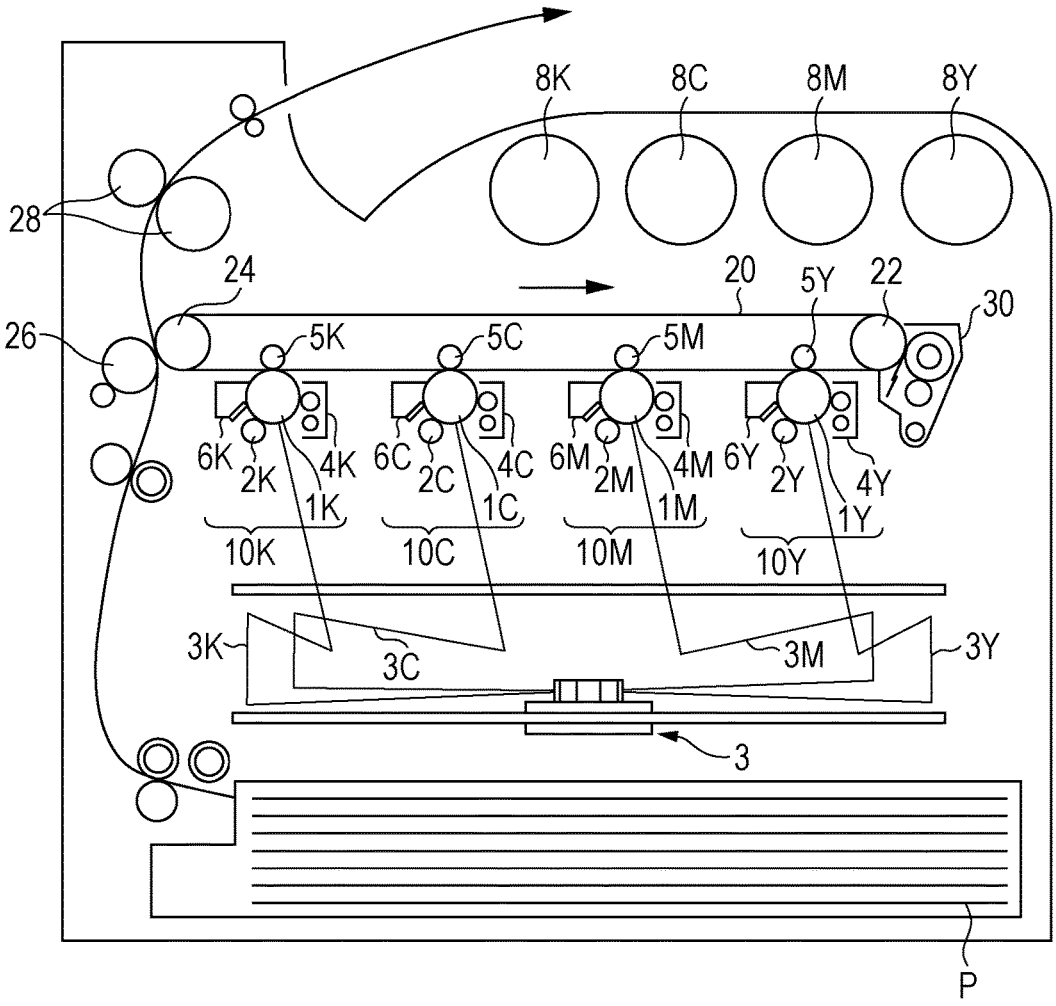
FIG. 1 is a schematic view of an example image-forming apparatus that may be used in this exemplary embodiment.

An electrostatic-image developing toner, an electrostatic image developer, a toner cartridge, an image-forming apparatus, and an image-forming method according to an exemplary embodiment of the present invention will now be described in detail.

Electrostatic-Image Developing Toner

A toner according to this exemplary embodiment contains toner particles containing a polycondensate resin and hydrophobic external additive particles (hereinafter also simply referred to as "external additive") having a volume average particle size of 40 to 200 nm or about 40 to about 200 nm. The electrostatic-image developing toner has a difference between a half-fall temperature T1/2A and a half-fall temperature T1/2B of 2.0° C. to 10° C. or about 2.0° C. to about 10° C. The half-fall temperature T1/2A is measured with a flow tester after storage in an environment at 50° C. and an absolute humidity of 16.5 g/m$^3$ for 2 hours. The half-fall temperature T1/2B is measured with a flow tester after storage in an environment at 50° C. and an absolute humidity of 82.7 g/m$^3$ for 2 hours.

As used herein, the term "offset" refers to a phenomenon in which some of the toner forming a toner image transferred to a transfer medium adheres to a fixing roller upon fixing.

As used herein, the term "image fogging" refers to a phenomenon in which toner particles adhere to a non-image area and are fixed.

When an electrostatic-image developing toner (hereinafter also simply referred to as "toner") is fixed at a low temperature (e.g., at 120° C. for temperature control in the range from 120° C. to 180° C.) to form an image in a high-temperature, high-humidity environment (e.g., at 28° C. and 85% RH), the toner forming the toner image may resist melting due to the presence of moisture in the toner, which increases the specific heat of the toner, so that the toner temperature rises slower. This may result in offset (cold offset), in which some of the toner forming the toner image adheres to a fixing member.

One approach to preventing cold offset is the use of a toner whose melt viscosity decreases in the presence of moisture in the toner as a result of plasticization of the resin present in the toner particles. This approach, however, may excessively decrease the viscosity of some of the toner and may thus result in offset (hot offset), in which some of the toner forming the toner image adheres to a fixing member at a high temperature in the fixing temperature range (e.g., at 180° C.)

In particular, hot offset may tend to occur for a toner to which hydrophobic external additive particles having a volume average particle size of 40 to 200 nm are added to control the chargeability of the toner so that the resulting image has reduced image fogging.

This is probably because, for example, the external additive particles intervene between the toner particles and the fixing member and hinder the release agent, which is incorporated into the toner particles to prevent hot offset, from contacting the fixing member, thus decreasing the release effect of the release agent on the toner particles and the fixing member.

Accordingly, the use of the toner according to this exemplary embodiment to form an image in a high-temperature, high-humidity environment may reduce image fogging and offset. A possible explanation is given below.

If the difference between T1/2A and T1/2B is 2.0° C. or more, the toner viscosity may decrease in a high-temperature, high-humidity environment, thus reducing cold offset.

If the difference between T1/2A and T1/2B is 10° C. or less, the toner viscosity may decrease moderately in a high-temperature, high-humidity environment, thus reducing hot offset.

In addition, if the difference between T1/2A and T1/2B of a toner containing hydrophobic external additive particles having a volume average particle size of 40 to 200 nm is 2.0° C. or more, the toner may soften readily during fixing, and therefore, the external additive particles may be readily embedded in the toner particles during fixing. This may facilitate contact of the release agent present in the toner particles with the fixing member, thus reducing hot offset.

In particular, if the toner in the developing unit is frequently replaced, as in the formation of images with high area coverage, the proportion of the external additive particles present on the surfaces of the toner particles may increase, thus further reducing hot offset.

In addition, if the difference between T1/2A and T1/2B of a toner containing external additive particles is 10° C. or less, it may be possible to avoid excessive softening of the toner after storage in a high-temperature, high-humidity environment before development, thus reducing the likelihood of the external additive particles being embedded in the toner particles before development. Therefore, the external additive particles may be effective in controlling the chargeability of the toner, thus reducing image fogging.

As used herein, the terms "hot offset" and "cold offset" are also collectively and simply referred to as "offset".

As described above, the use of the electrostatic-image developing toner according to this exemplary embodiment to form an image in a high-temperature, high-humidity environment may reduce image fogging and offset.

T1/2A and T1/2B

To reduce image fogging and offset, the toner according to this exemplary embodiment has a difference between T1/2A and T1/2B of 2.0° C. to 10° C. or about 2.0° C. to about 10° C., preferably 2.5° C. to 6.0° C. or about 2.5° C. to about 6.0° C., more preferably 2.5° C. to 4.0° C. or about 2.5° C. to about 4.0° C.

The half-fall temperature (T1/2A and T1/2B) of the toner is measured with a CFT-500 Koka-type flow tester (available from Shimadzu Corporation) as the temperature corresponding to half the fall height of a plunger in the range from the flow start point to the flow end point when a 1 $cm^3$ sample is melted and forced to flow through a die orifice with a diameter of 1.0 mm under a load of 0.23 MPa (2.3 $kg/cm^2$) at a heating rate of 3° C./min.

The difference between T1/2A and T1/2B is controlled with the resin present in the toner particles and the method for manufacturing the toner particles. For example, if the toner particles are manufactured by pulverization, the difference between T1/2A and T1/2B is controlled by adjusting the feed rate of the resin.

For example, a decrease in the feed rate of the resin during mixing increases the difference between T1/2A and T1/2B. This is probably because a decrease in the feed rate of the resin during mixing increases the degree of mixing for reasons such as the progress of the hydrolysis of the polyester resin during mixing and thus promotes the plasticization of the resin present in the toner particles of the resulting toner in a high-temperature, high-humidity environment.

Melt Viscosity of Toner

To ensure sufficient low-temperature fixability in a high-temperature, normal-humidity environment (e.g., at 35° C. to 50° C. and 20% RH), it is preferred that the toner have a viscosity at 120° C. of $2.2\times10^4$ to $6.0\times10^4$ Pa·s or about $2.2\times10^4$ to about $6.0\times10^4$ Pa·s, more preferably $2.2\times10^4$ to $5.0\times10^4$ Pa·s or about $2.2\times10^4$ to about $5.0\times10^4$ Pa·s, even more preferably $2.2\times10^4$ to $4.0\times10^4$ Pa·s or about $2.2\times10^4$ to about $4.0\times10^4$ Pa·s, after storage in an environment at 50° C. and an absolute humidity of 16.5 $g/m^3$ for 2 hours.

To reduce image fogging and offset in a high-temperature, high-humidity environment, it is preferred that the toner have a viscosity at 120° C. of $0.5\times10^4$ to $2.2\times10^4$ Pa·s or about $0.5\times10^4$ to about $2.2\times10^4$ Pa·s, more preferably $1.0\times10^4$ to $2.2\times10^4$ Pa·s or about $1.0\times10^4$ to about $2.2\times10^4$ Pa·s, even more preferably $1.5\times10^4$ to $2.2\times10^4$ Pa·s or about $1.5\times10^4$ to about $2.2\times10^4$ Pa·s, after storage in an environment at 50° C. and an absolute humidity of 82.7 $g/m^3$ for 2 hours.

To reduce offset in a high-temperature, high-humidity environment, it is preferred that the melt viscosity T120 of the toner at 120° C. after storage in an environment at 50° C. and an absolute humidity of 82.7 $g/m^3$ for 2 hours and the melt viscosity T180 of the toner at 180° C. after storage in an environment at 50° C. and an absolute humidity of 82.7 $g/m^3$ for 2 hours satisfy $0.2\leq(T180/1120)\leq0.5$ or about $0.2\leq(T180/1120)\leq$about 0.5, more preferably $0.2\leq(T180/1120)\leq0.4$ or about $0.2\leq(T180/1120)\leq$about 0.4, even more preferably $0.2\leq(T180/1120)\leq0.3$ or about $0.2\leq(T180/1120)\leq$about 0.3.

Glass Transition Temperature of Toner

To reduce offset in a high-temperature, high-humidity environment, the electrostatic-image developing toner according to this exemplary embodiment may have a glass transition temperature of 50° C. to 70° C.

The glass transition temperature of the toner according to this exemplary embodiment is determined from a differential scanning calorimetry (DSC) curve. Specifically, the glass transition temperature (Tg) is determined as the extrapolated glass transition initiation temperature defined in the "Determination of Glass Transition Temperature" section of JIS K 7121-1987 "Testing Methods for Transition Temperatures of Plastics". The measurement is performed with a DSC-20 thermal analyzer (available from Seiko Instruments Inc.) by heating 10 mg of a sample at a constant heating rate (10° C./min).

Toner Particles

The toner particles in the toner according to this exemplary embodiment contain a polycondensate resin. The toner particles may optionally further contain a colorant, a release agent, and other ingredients.

The individual ingredients of the toner particles will now be described.

Polycondensate Resin

The term "polycondensate resin" (hereinafter also simply referred to as "resin") refers to a resin obtained by the condensation polymerization of multiple monomers. This term does not encompass resins obtained by the addition polymerization of multiple monomers.

Examples of resins that may be used in this exemplary embodiment include non-vinyl resins such as polyester resins, polyurethane resins, polyamide resins, cellulose resins, polyether resins, and modified rosins. Polyester resins are preferred for reasons of low-temperature fixability.

These resins may be used alone or in combination.

Polyester Resin

A polyester resin for use as the resin in this exemplary embodiment may be a polycondensate of at least one polyol compound and at least one polycarboxylic acid compound.

To reduce image fogging and offset in a high-temperature, high-humidity environment, it is preferred that the polyester resin be a polycondensate of at least one polyol compound and at least one polycarboxylic acid compound, and the at least one polyol compound include an aliphatic polyol compound in an amount of 70% to 100% by mass or about 70% to about 100% by mass, more preferably 90% to 100% by mass or about 90% to about 100% by mass, even more preferably 95% to 100% by mass or about 95% to about 100% by mass, further preferably 99% to 100% by mass or about 99% to about 100% by mass, based on the total mass of the at least one polyol compound.

The at least one polyol compound preferably includes a diol compound, more preferably an aliphatic diol compound.

The at least one polycarboxylic acid compound may include a dicarboxylic acid compound.

The polyester resin, which is a polycondensate of the at least one polyol compound and the at least one polycarboxylic acid compound, may be prepared using other compounds as starting materials in addition to the at least one polycarboxylic acid compound and the at least one polyol compound, preferably a polyester resin prepared from the at least one polycarboxylic acid compound, the at least one polyol compound, and at least one polyepoxy compound.

Examples of polyol compounds include diols such as ethylene glycol, 1,2-propylene glycol, 1,3-propylene glycol, 1,4-butanediol, 1,5-pentanediol, 1,6-hexanediol, neopentyl glycol, 1,4-butenediol, 1,7-heptanediol, and 1,8-octanediol; and polyols with a functionality of 3 or more such as glycerol, pentaerythritol, and trimethylolpropane. Among these, the at least one polyol compound preferably includes at least one compound selected from the group consisting of ethylene glycol and neopentyl glycol to reduce image fogging and offset in a high-temperature, high-humidity environment.

The at least one polyol compound may include a polyol compound other than aliphatic polyol compounds, for example, an aromatic diol compound such as an alkylene (having 2 or 3 carbon atoms) oxide adduct (an average of 1 to 10 moles added) of bisphenol A.

The aromatic diol compound decreases the moisture absorbency of the resin, thus increasing the value of T1/2B. To achieve a difference between T1/2A and T1/2B of 2.0° C. to 10° C. or about 2.0° C. to about 10° C., it is preferred that the aromatic diol compound be present in an amount of 0% to 30% by mass or about 0% to about 30% by mass, more preferably 0% to 10% by mass or about 0% to about 10% by mass, even more preferably 0% to 5% by mass or about 0% to about 5% by mass, further preferably 0% to 1% by mass or about 0% to about 1% by mass, based on the total mass of the at least one polyol compound.

Examples of polycarboxylic acid compounds include aromatic polycarboxylic acid compounds such as phthalic acid, isophthalic acid, terephthalic acid, trimellitic acid, pyromellitic acid, and monosodium 5-sulfoisophthalate; aliphatic polycarboxylic acid compounds such as fumaric acid, maleic acid, adipic acid, succinic acid, and succinic acids substituted with an alkyl group having 1 to 20 carbon atoms or an alkenyl group having 2 to 20 carbon atoms, such as dodecenylsuccinic acid and octenylsuccinic acid; and anhydrides and alkyl (having 1 to 8 carbon atoms) esters thereof.

Preferred among these polycarboxylic acid compounds are dicarboxylic acid compounds.

For reasons of chargeability, it is preferred that the at least one polycarboxylic acid compound include an aromatic polycarboxylic acid compound, more preferably an aromatic dicarboxylic acid compound.

The at least one polycarboxylic acid compound may include a polycarboxylic acid compound having a sulfo group or a salt thereof, such as monosodium 5-sulfoisophthalate.

The aromatic polycarboxylic acid compound is preferably present in the polyester resin in an amount of 70% to 100% by mass, more preferably 80% to 100% by mass, even more preferably 90% to 100% by mass, further preferably 100% by mass, based on the total mass of the at least one polycarboxylic acid compound used as a starting material.

The polyester resin may be a polycondensate of the at least one polycarboxylic acid compound, the at least one polyol compound, and at least one polyepoxy compound.

Examples of polyepoxy compounds include bisphenol A epoxy resins, novolac epoxy resins, ethylene glycol diglycidyl ether, glycerol triglycidyl ether, trimethylolpropane triglycidyl ether, trimethylolethane triglycidyl ether, pentaerythritol tetraglycidyl ether, hydroquinone diglycidyl ether, cresol novolac epoxy resins, phenol novolac epoxy resins, polymers and copolymers of vinyl compounds having an epoxy group, epoxylated resorcinol-acetone condensates, and partially epoxylated polybutadiene. In particular, cresol novolac epoxy resins and phenol novolac epoxy resins are preferred for reasons of reactivity.

The at least one polyepoxy compound is preferably used in the polyester resin in an amount of 1 to 20 mole percent or about 1 to about 20 mole percent, more preferably 2 to 15 mole percent or about 2 to about 15 mole percent, even more preferably 5 to 12 mole percent or about 5 to about 12 mole percent, based on the total moles of the at least one polyol compound.

As the monomer units derived from the polyol compound, the polyester resin may contain monomer units represented by formula (1):

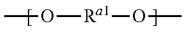

(1)

where $R^{al}$ represents an alkylene group having 2 to 8 carbon atoms.

The alkylene group for $R^{al}$ may be a linear alkylene group or a branched alkylene group.

In formula (1), $R^{al}$ is preferably an alkylene group having 2 to 4 carbon atoms, more preferably an alkylene group having 2 or 3 carbon atoms.

The polyester resin preferably has a weight average molecular weight Mw of 10,000 to 200,000, more preferably 30,000 to 150,000, even more preferably 60,000 to 120,000.

The weight average molecular weight of the resin in this exemplary embodiment is determined from a molecular weight measurement by gel permeation chromatography (GPC) with a solution of the resin in tetrahydrofuran (THF). The measurement is performed by allowing a solution of the resin in THF to pass through a column such as a TSK-GEL column (GMH (available from Tosoh Corporation)) with THF eluent. The molecular weight of the resin is then calculated using a molecular weight calibration curve created from monodisperse polystyrene standards.

Such polyester resins may be used alone or in combination.

The polyester resin may be present in the electrostatic-image developing toner according to this exemplary embodiment in an amount of 50% to 99% by mass, more preferably 60% to 97% by mass, even more preferably 70% to 95% by mass, based on the total mass of the toner.

The polyester resin is obtained by a known method of manufacture. Specifically, for example, the polyester resin is obtained by reacting the monomers at a polymerization temperature of 180° C. to 230° C., optionally while removing water and alcohol produced by condensation from the reaction system under reduced pressure.

If the monomers used as starting materials are insoluble in or incompatible with each other at the reaction temperature, the monomers may be dissolved by adding a high-boiling-point solvent as a solubilizer. In this case, a polycondensation reaction is performed while the solubilizer is being distilled off. If there is any poorly compatible monomer, the poorly compatible monomer may be condensed with any carboxylic acid compound or alcohol compound to be polycondensed with that monomer in advance before they are polycondensed with the major ingredients.

Colorant

Examples of colorants include various pigments such as carbon black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

Optionally, the colorant may be surface-treated or may be used in combination with a dispersant. A combination of colorants may also be used.

The colorant is preferably present in an amount of, for example, 1% to 30% by mass, more preferably 3% to 15% by mass, based on the total mass of the toner particles.

Release Agent

Examples of release agents include, but not limited to, hydrocarbon waxes; natural waxes such as carnauba wax, rice wax, and candelilla wax; synthetic, mineral, and petroleum waxes such as montan wax; and ester waxes such as fatty acid esters and montanic acid esters.

The release agent preferably has a melting temperature of 50° C. to 110° C., more preferably 60° C. to 100° C.

The melting temperature is determined from a DSC curve as the melting peak temperature defined in the "Determination of Melting Temperature" section of JIS K 7121-1987 "Testing Methods for Transition Temperatures of Plastics".

The release agent is preferably present in an amount of, for example, 1% to 20% by mass, more preferably 5% to 15% by mass, based on the total mass of the toner particles.

Other Resins

Although the toner particles used in this exemplary embodiment may contain a resin other than the polycondensate resin (another resin), the toner particles need not contain other resins.

If the toner particles contain another resin, the other resin is present in a smaller amount than the polycondensate resin. Preferably, the other resin is present in an amount of 10% by mass or less, more preferably 5% by mass or less, even more preferably 0% by mass.

Examples of other resins include, but not limited to, homopolymers and copolymers, as well as mixtures thereof, of monomers such as styrenes such as styrene, p-chlorostyrene, and a-methylstyrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene.

For example, styrene resins, (meth)acrylic resins, and styrene-(meth)acrylic copolymer resins are obtained by known methods using styrene monomers and (meth)acrylic monomers alone or in combination. The term "(meth) acrylic" encompasses both acrylic and methacrylic.

If a styrene resin, a (meth)acrylic resin, or a copolymer resin thereof is used, the resin may have a weight average molecular weight Mw of 20,000 to 100,000 and a number average molecular weight Mn of 2,000 to 30,000.

Other Additives

In addition to the above ingredients, various ingredients such as internal additives and charge control agents may optionally be added to the electrostatic-image developing toner according to this exemplary embodiment.

Examples of internal additives include magnetic materials such as metals, alloys, and metal compounds such as ferrite, magnetite, reduced iron, cobalt, nickel, and manganese.

Examples of charge control agents include quaternary ammonium salt compounds, nigrosin compounds, complex dyes such as aluminum, iron, and chromium complex dyes, and triphenylmethane pigments.

Properties of Toner Particles

The toner particles may be single-layer toner particles or core-shell toner particles, which are composed of a core (core particle) and a coating layer (shell layer) covering the core.

For example, the core-shell toner particles may be composed of a core containing a resin and optionally other ingredients such as a colorant and a release agent and a coating layer containing a resin.

The toner particles preferably have a volume average particle size (D50v) of 2 to 10 μm, more preferably 4 to 8 μm.

Various average particle sizes and particle size distribution indices of the toner particles are measured with a Coulter Multisizer II (available from Beckman Coulter, Inc.) using ISOTON-II (available from Beckman Coulter, Inc.) as an electrolyte solution.

Prior to measurement, 0.5 to 50 mg of a test sample is added to 2 mL of a 5% aqueous solution of a surfactant (e.g., sodium alkylbenzenesulfonate), serving as a dispersant, and the mixture is added to 100 to 150 mL of the electrolyte solution.

The sample suspended in the electrolyte solution is dispersed with a sonicator for 1 minute. The particle size distribution of particles having particle sizes in the range of 2 to 60 μm is then measured with a Coulter Multisizer II using an aperture with an aperture diameter of 100 μm. A total of 50,000 particles are sampled.

Based on the measured particle size distribution, cumulative distributions by volume and number are plotted against particle size ranges (channels) from smaller sizes. The volume particle size D16v and the number particle size D16p are defined as the particle size at which the cumulative volume is 16% and the particle size at which the cumulative number is 16%, respectively. The volume average particle size D50v and the number average particle size D50p are defined as the particle size at which the cumulative volume is 50% and the particle size at which the cumulative number is 50%, respectively. The volume particle size D84v and the number particle size D84p are defined as the particle size at which the cumulative volume is 84% and the particle size at which the cumulative number is 84%, respectively.

With these values, the volume particle size distribution index (GSDv) is calculated as $(D84v/D16v)^{1/2}$, and the number particle size distribution index (GSDp) is calculated as $(D84p/D16p)^{1/2}$.

The toner particles preferably have an average circularity of 0.94 to 1.00, more preferably 0.95 to 0.98.

Method for Manufacturing Toner Particles

The toner particles may be manufactured by any method, such as suspension polymerization, solution suspension, emulsion polymerization, or pulverization.

Pulverization readily provides a broad particle size distribution and readily produces a large amount of fine powder with a large volume average particle size.

Emulsion polymerization readily provides a small toner particle size with a narrow particle size distribution and simultaneously allows for toner surface smoothening and sphericity control.

For pulverization, the toner particles are prepared, for example, as follows. For example, a polycondensate resin, a release agent, a charge control agent, and a colorant are sufficiently mixed together in a mixer such as a Henschel mixer or ball mill. The mixture is then melt-mixed with a thermal mixer such as a heating roller, kneader, or extruder to disperse or dissolve the release agent, the charge control agent, and the colorant in the molten resin. The melt mixture is solidified by cooling, is mechanically pulverized to the desired particle size, and is classified to adjust the particle size distribution. Alternatively, the melt mixture is solidified by cooling, is forced to collide with a target under a jet stream, and is formed into spheres by heat or mechanical impact to obtain toner particles.

In the pulverization process, an IDS-2 impact-plate pulverizer (available from Nippon Pneumatic Mfg. Co., Ltd.) may be used for pulverization, and an Elbow-Jet classifier (available from MATSUBO Corporation) may be used for classification. In the pulverization step, the particle size of the toner particles is readily controlled since it has been found that the toner particles become smaller and finer with increasing pulverization pressure and decreasing throughput. In the subsequent classification step, the amount of fine powder is readily controlled by changing the classifying edge position.

For pulverization, the difference between T1/2A and T1/2B is controlled, for example, by adjusting the feed rate of the resin during mixing. For example, the difference between T1/2A and T1/2B becomes larger with decreasing feed rate of the resin during mixing.

The feed rate of the resin varies depending on the equipment used.

The difference between T1/2A and T1/2B is also controlled by adjusting the temperature during mixing.

Although the temperature during mixing varies depending on the type of resin, the preferred temperature is 110° C. to 160° C., more preferably 120° C. to 150° C.

Hydrophobic External Additive Particles

The electrostatic-image developing toner according to this exemplary embodiment contains hydrophobic external additive particles having a volume average particle size of 40 to 200 nm or about 40 to about 200 nm.

Examples of hydrophobic external additive particles include hydrophobically treated inorganic particles and hydrophobic resin particles.

Any inorganic particles may be used, including inorganic particles known as external additives for toners. Examples of inorganic particles include silica, alumina, titanium oxides (e.g., titanium oxide and metatitanic acid), cerium oxide, zirconia, calcium carbonate, magnesium carbonate, calcium phosphate, and carbon black. Among these, silica particles are preferred.

These inorganic particles are treated by a technique such as immersion in a hydrophobic agent to obtain hydrophobically treated inorganic particles. Examples of hydrophobic agents include, but not limited to, silane coupling agents, silicone oils, titanate coupling agents, and aluminum coupling agents. These hydrophobic agents may be used alone or in combination.

In this exemplary embodiment, commercially available hydrophobically treated silica particles may also be used.

The hydrophobic agent may be present in an amount of, for example, 1 to 10 parts by mass based on 100 parts by mass of the inorganic particles.

Examples of hydrophobic resin particles include particles of hydrophobic resins such as styrene resins such as polystyrene, (meth)acrylic resins such as poly(methyl methacrylate) (PMMA), and melamine resins, more preferably poly (methyl methacrylate).

The hydrophobic external additive particles have a volume average particle size of 40 to 200 nm or about 40 to about 200 nm. To control the toner chargeability and reduce image fogging, it is preferred that the hydrophobic external additive particles have a volume average particle size of 40 to 150 nm, more preferably 40 to 90 nm.

The volume average particle size of the hydrophobic external additive particles is measured with a Nanotrac UPA dynamic light scattering particle size and particle size distribution analyzer (available from Nikkiso Co., Ltd.).

Other External Additives

The electrostatic-image developing toner according to this exemplary embodiment may contain another external additive.

Examples of other external additives include hydrophilic external additives and hydrophobic external additives having volume average particle sizes of less than 40 nm, preferably hydrophobic external additives having volume average particle sizes of less than 40 nm.

Other external additives that may be used include external additives known as external additives for toners, including inorganic particles such as silica, alumina, titanium oxides (e.g., titanium oxide and metatitanic acid), cerium oxide, zirconia, calcium carbonate, magnesium carbonate, calcium phosphate, and carbon black. Among these, silica particles are preferred.

These inorganic particles may be hydrophobically treated in the manner as described above.

The other external additive preferably has a volume average particle size of 5 to less than 40 nm, more preferably 10 to less than 40 nm.

The other external additive is preferably added in an amount of 0.1 to 5 parts by mass, more preferably 0.3 to 2 parts by mass, based on 100 parts by mass of the toner. The addition of 0.1 part by mass or more of the other external additive may provide moderate toner flowability, good chargeability, and good charge exchangeability. The addition of 5 parts by mass or less of the other external additive may provide moderate coverage and may thus reduce the transfer of the external additive to a contact member and the problems associated therewith.

Method for Adding External Additive

External additives may be added to the electrostatic-image developing toner according to this exemplary embodiment by any known method. For example, a toner is obtained by mixing together toner particles and various external additives in a Henschel mixer and then removing coarse particles with a sieve (screen classifier).

Electrostatic Image Developer

An electrostatic image developer according to this exemplary embodiment contains at least the toner according to this exemplary embodiment.

The electrostatic image developer according to this exemplary embodiment may be a one-component developer containing only the toner according to this exemplary embodiment or a two-component developer containing the toner and a carrier.

The carrier may be any known carrier. Examples of carriers include coated carriers, which are obtained by coating magnetic powders as core materials with coating resins; magnetic powder dispersion carriers, which are obtained by dispersing and mixing magnetic powders in matrix resins; and resin-impregnated carriers, which are formed by impregnating porous magnetic powders with resins.

The particles that form magnetic powder dispersion carriers and resin-impregnated carriers may be coated as core materials with coating resins.

Examples of magnetic powders include magnetic metals such as iron, nickel, and cobalt and magnetic oxides such as ferrite and magnetite.

Examples of coating resins and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins.

These coating resins and matrix resins may contain additives such as conductive particles.

Examples of conductive particles include particles of metals such as gold, silver, and copper and other conductive materials such as carbon black, titanium oxide, zinc oxide, tin oxide, barium sulfate, aluminum borate, and potassium titanate.

To coat a core material with a coating resin, for example, the core material may be coated with a solution, for forming a coating layer, prepared by dissolving a coating resin and optionally various additives in a suitable solvent. The solvent may be any solvent selected depending on factors such as the type of coating resin used and suitability for coating.

Specific techniques for coating a core material with a coating resin include dipping, in which a core material is dipped in a solution for forming a coating layer; spraying, in which a core material is sprayed with a solution for forming a coating layer; fluidized bed coating, in which a core material is sprayed with a solution for forming a coating layer while being suspended in an air stream; and kneader coating, in which a carrier core material and a solution for forming a coating layer are mixed together in a kneader coater, followed by removing the solvent.

The mixing ratio (by mass) of the toner to the carrier in the two-component developer is preferably 1:100 to 30:100, more preferably 3:100 to 20:100.

Image-Forming Apparatus and Image-Forming Method

An image-forming apparatus and an image-forming method according to this exemplary embodiment will now be described.

The image-forming apparatus according to this exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, a transfer unit that transfers the toner image from the surface of the image carrier to a surface of a recording medium, and a fixing unit that fixes the toner image to the surface of the recording medium. The electrostatic image developer is the electrostatic image developer according to this exemplary embodiment.

The image-forming apparatus according to this exemplary embodiment executes an image-forming method (the image-forming method according to this exemplary embodiment) including a charging step of charging the surface of the image carrier, an electrostatic-image forming step of forming an electrostatic image on the charged surface of the image carrier, a developing step of developing the electrostatic image formed on the surface of the image carrier with the electrostatic image developer according to this exemplary embodiment to form a toner image, a transfer step of transferring the toner image from the surface of the image carrier to a surface of a recording medium, and a fixing step of fixing the toner image to the surface of the recording medium.

The image-forming apparatus according to this exemplary embodiment may be a known type of image-forming apparatus such as a direct-transfer apparatus, which transfers a toner image from a surface of an image carrier directly to a recording medium; an intermediate-transfer apparatus, which transfers a toner image from a surface of an image carrier to a surface of an intermediate transfer member and then transfers the toner image from the surface of the intermediate transfer member to a surface of a recording medium; an apparatus including a cleaning unit that cleans a surface of an image carrier after the transfer of a toner image and before charging; or an apparatus including an erase unit that removes any charge from a surface of an image carrier by irradiation with erase light after the transfer of a toner image and before charging.

For an intermediate-transfer apparatus, the transfer unit includes, for example, an intermediate transfer member having a surface to which a toner image is transferred, a first transfer unit that transfers a toner image from the surface of the image carrier to the surface of the intermediate transfer member, and a second transfer unit that transfers the toner image from the surface of the intermediate transfer member to a surface of a recording medium.

In the image-forming apparatus according to this exemplary embodiment, for example, the section including the developing unit may form a cartridge structure (process cartridge) attachable to and detachable from the image-forming apparatus. The process cartridge may include, for example, a developing unit containing the electrostatic image developer according to this exemplary embodiment.

A non-limiting example of the image-forming apparatus according to this exemplary embodiment will now be described. The following description will focus on the relevant parts shown in the drawings, and a description of other parts is omitted herein.

FIG. 1 is a schematic view of the image-forming apparatus according to this exemplary embodiment.

The image-forming apparatus shown in FIG. 1 includes first to fourth electrophotographic image-forming units 10Y, 10M, 10C, and 10K that produce yellow (Y), magenta (M), cyan (C), and black (K) images, respectively, based on image data generated by color separation. These image-forming units (which may be hereinafter simply referred to as "units") 10Y, 10M, 10C, and 10K are arranged side-by-side at a predetermined distance from each other in the horizontal direction. These units 10Y, 10M, 10C, and 10K may form process cartridges attachable to and detachable from the image-forming apparatus.

An intermediate transfer belt 20, serving as an intermediate transfer member, extends above and through the units 10Y, 10M, 10C, and 10K in the figure. The intermediate transfer belt 20 is entrained about a drive roller 22 and a support roller 24 so that the intermediate transfer belt 20 runs in the direction from the first unit 10Y toward the fourth unit 10K. The drive roller 22 is disposed at a distance from the support roller 24 in the direction from left to right in the figure. The support roller 24 is disposed in contact with the inner surface of the intermediate transfer belt 20. The support roller 24 is urged away from the drive roller 22 by a member such as a spring (not shown) to apply tension to the intermediate transfer belt 20 entrained about the two rollers 22 and 24. An intermediate-transfer-belt cleaning device 30 is disposed on the image carrier side of the intermediate transfer belt 20 and opposite the drive roller 22.

The developing devices (developing units) 4Y, 4M, 4C, and 4K of the units 10Y, 10M, 10C, and 10K are supplied with toners, including yellow, magenta, cyan, and black toners, from toner cartridges 8Y, 8M, 8C, and 8K, respectively.

Since the first to fourth units 10Y, 10M, 10C, and 10K have the same configuration, the first unit 10Y, which is a yellow-image forming unit disposed upstream in the running direction of the intermediate transfer belt 20, will be described as a representative example. The same parts as in the first unit 10Y are labeled with the same reference numerals followed by the letters M (magenta), C (cyan), and K (black), rather than the letter Y (yellow), and a description of the second to fourth units 10M, 10C, and 10K is omitted herein.

The first unit 10Y includes a photoreceptor 1Y serving as an image carrier. Around the photoreceptor 1Y are disposed, in sequence, a charging roller (an example of a charging unit) 2Y that charges the surface of the photoreceptor 1Y to a predetermined potential, an exposure device (an example of an electrostatic-image forming unit) 3 that exposes the charged surface of the photoreceptor 1Y to a laser beam 3Y based on image signals generated by color separation to form an electrostatic image, a developing device (an example of a developing unit) 4Y that supplies a charged toner to the electrostatic image to develop the electrostatic image, a first transfer roller (an example of a first transfer unit) 5Y that transfers the developed toner image to the intermediate transfer belt 20, and a photoreceptor cleaning device (an example of a cleaning unit) 6Y that removes any residual toner from the surface of the photoreceptor 1Y after the first transfer.

The first transfer roller 5Y is disposed inside the intermediate transfer belt 20 and opposite the photoreceptor 1Y. The first transfer rollers 5Y, 5M, 5C, and 5K are each connected to a bias supply (not shown) that applies a first transfer bias. Each bias supply is controlled by a controller (not shown) to change the transfer bias applied to the corresponding first transfer roller.

The yellow-image forming operation of the first unit 10Y will now be described.

Prior to the operation, the surface of the photoreceptor 1Y is charged to a potential of −600 to −800 V by the charging roller 2Y.

The photoreceptor 1Y includes a photosensitive layer formed on a conductive (e.g., having a volume resistivity of $1\times10^{-6}$ Ωcm or less at 20° C.) substrate. The photosensitive layer, which normally has high resistivity (the resistivity of common resins), has the property of, upon exposure to the laser beam 3Y, changing its resistivity in the area exposed to the laser beam 3Y. Accordingly, the laser beam 3Y is directed onto the charged surface of the photoreceptor 1Y via the exposure device 3 based on yellow image data fed from a controller (not shown). The photosensitive layer forming the surface of the photoreceptor 1Y is exposed to the laser beam 3Y, thereby forming an electrostatic image of the yellow image pattern on the surface of the photoreceptor 1Y.

The term "electrostatic image" refers to an image formed on the surface of the photoreceptor 1Y by electric charge, i.e., a negative latent image formed after electric charge dissipates from the surface of the photoreceptor 1Y in the area exposed to the laser beam 3Y, where the resistivity of the photosensitive layer has decreased, while remaining in the area not exposed to the laser beam 3Y.

As the photoreceptor 1Y rotates, the electrostatic image formed on the photoreceptor 1Y is transported to a predetermined developing position. At the developing position, the electrostatic image on the photoreceptor 1Y is made visible (developed) to form a toner image by the developing device 4Y.

The developing device 4Y contains, for example, an electrostatic image developer containing at least a yellow toner and a carrier. The yellow toner is triboelectrically charged while being stirred in the developing device 4Y. The yellow toner, which has been charged to the same polarity (negative) as the surface of the photoreceptor 1Y, is carried on a developer roller (an example of a developer carrier). As the surface of the photoreceptor 1Y passes through the developing device 4Y, the yellow toner is electrostatically attracted to and develops the latent image formed on the surface of the photoreceptor 1Y. As the photoreceptor 1Y having the yellow toner image formed thereon continues to rotate at a predetermined speed, the toner image formed on the photoreceptor 1Y is transported to a predetermined first transfer position.

When the yellow toner image on the photoreceptor 1Y is transported to the first transfer position, a first transfer bias is applied to the first transfer roller 5Y. The first transfer bias exerts an electrostatic force acting from the photoreceptor 1Y toward the first transfer roller 5Y on the toner image to transfer the toner image from the photoreceptor 1Y to the intermediate transfer belt 20. The transfer bias applied is opposite in polarity (positive) to the toner (negative). For example, the transfer bias for the first unit 10Y is controlled to +10 μA by a controller (not shown).

Any residual toner is removed and collected from the photoreceptor 1Y by the photoreceptor cleaning device 6Y.

The first transfer biases applied to the first transfer rollers 5M, 5C, and 5K of the second, third, and fourth units 10M, 10C, and 10K are controlled in the same manner as the first transfer bias applied to the first transfer roller 5Y of the first unit 10Y.

In this way, the intermediate transfer belt 20 to which the yellow toner image has been transferred in the first unit 10Y is sequentially transported through the second, third, and fourth units 10M, 10C, and 10K to transfer toner images of the corresponding colors to the intermediate transfer belt 20 such that the toner images are superimposed on top of each other.

The toner images of the four colors transferred to the intermediate transfer belt 20 through the first to fourth units 10Y, 10M, 10C, and 10K are transported to a second transfer section including the intermediate transfer belt 20, the support roller 24 in contact with the inner surface of the intermediate transfer belt 20, and a second transfer roller (an example of a second transfer unit) 26 disposed on the image carrier side of the intermediate transfer belt 20. A sheet of recording paper (an example of a recording medium) P is fed into the nip between the second transfer roller 26 and the intermediate transfer belt 20 at a predetermined timing by a feed mechanism, and a second transfer bias is applied to the support roller 24. The transfer bias applied is identical in polarity (negative) to the toner (negative). The second transfer bias exerts an electrostatic force acting from the intermediate transfer belt 20 toward the recording paper P on the toner image to transfer the toner image from the intermediate transfer belt 20 to the recording paper P. The second transfer bias is determined depending on the resistance detected by a resistance detector (not shown) that detects the resistance of the second transfer section, and the voltage is controlled accordingly.

The recording paper P is then transported into the nip between a pair of fixing rollers in a fixing device (an example of a fixing unit) 28. The toner image is fixed to the recording paper P to form a fixed image.

Examples of the recording paper P to which the toner image is transferred include plain paper used for systems such as electrophotographic copiers and printers. Examples of recording media other than the recording paper P include OHP sheets.

The recording paper P may have a smooth surface so that the fixed image has improved surface smoothness. For example, coated paper, which is plain paper coated with a resin or other material, and art paper for printing may be used.

The recording paper P having the fixed color image is transported to an output section, and the color-image forming operation ends.

Process Cartridge and Toner Cartridge

A process cartridge according to this exemplary embodiment will now be described.

The process cartridge according to this exemplary embodiment is attachable to and detachable from an image-forming apparatus. The process cartridge according to this exemplary embodiment includes a developing unit that contains the electrostatic image developer according to this exemplary embodiment and that develops an electrostatic image formed on a surface of an image carrier with the electrostatic image developer to form a toner image.

The process cartridge according to this exemplary embodiment need not have the configuration described above, but may have a configuration including a developing unit and optionally at least one other unit selected from, for example, an image carrier, a charging unit, an electrostatic-image forming unit, and a transfer unit.

A non-limiting example of the process cartridge according to this exemplary embodiment will now be described. The following description will focus on the relevant parts shown in the drawings, and a description of other parts is omitted herein.

Figure 2:
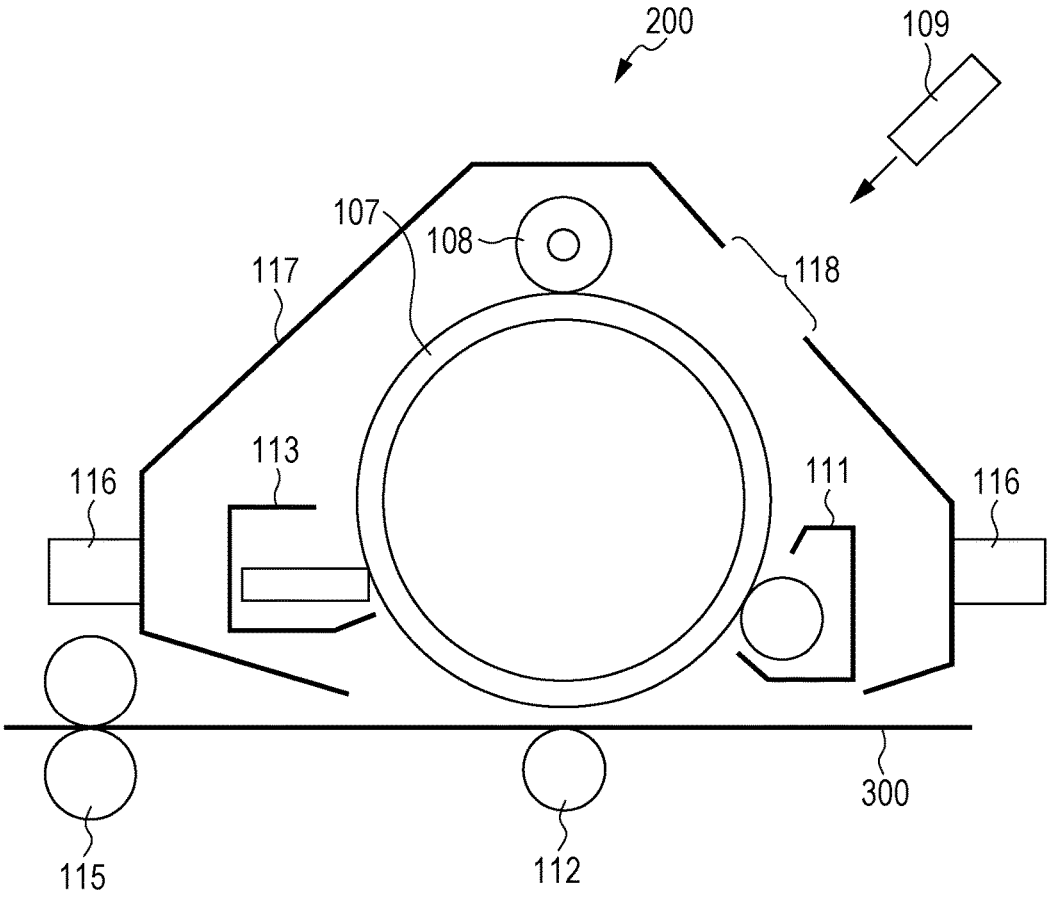
FIG. 2 is a schematic view of an example process cartridge according to this exemplary embodiment.

FIG. 2 is a schematic view of the process cartridge according to this exemplary embodiment.

A process cartridge 200 shown in FIG. 2 includes, for example, a housing 117 having mounting rails 116 and an opening 118 for exposure. The housing 117 holds together a photoreceptor 107 (an example of an image carrier) and a charging roller 108 (an example of a charging unit), a developing device 111 (an example of a developing unit), and a photoreceptor cleaning device 113 (an example of a cleaning unit) that are disposed around the photoreceptor 107, thereby forming a cartridge.

FIG. 2 also illustrates an exposure device 109 (an example of an electrostatic-image forming unit), a transfer device 112 (an example of a transfer unit), a fixing device 115 (an example of a fixing unit), and recording paper 300 (an example of a recording medium).

A toner cartridge according to this exemplary embodiment will now be described.

The toner cartridge according to this exemplary embodiment is attachable to and detachable from an image-forming apparatus and contains the toner according to this exemplary embodiment. The toner cartridge contains refill toner to be supplied to a developing unit disposed in an image-forming apparatus.

The image-forming apparatus shown in FIG. 1 is configured such that the toner cartridges 8Y, 8M, 8C, and 8K are attachable to and detachable from the image-forming apparatus. The developing devices 4Y, 4M, 4C, and 4K are connected to the toner cartridges corresponding to the respective developing devices (colors) through toner supply tubes (not shown). The toner cartridges are replaced when the toner level is low.

EXAMPLES

This exemplary embodiment is further illustrated by the following examples, although these examples are not intended to limit this exemplary embodiment. Parts and percentages are by mass unless otherwise specified.

Preparation of Polyester Resin (A1)

Polycarboxylic Acid Compounds

Terephthalic acid: 90 molar equivalents

Monosodium 5-sulfoisophthalate: 1 molar equivalent

Polyol Compounds

Ethylene glycol: 50 molar equivalents 1,5-Pentanediol: 50 molar equivalents

Epoxy Compound

Polyepoxy compound (EPICLON N-695 available from DIC corporation): 9 molar equivalents In a flask equipped with a stirrer, a nitrogen inlet tube, a temperature sensor, and a fractionating column are placed a total of 3 parts by mass of the above polycarboxylic acid compounds and polyol compounds. The temperature is increased to 190° C. over 1 hour. After it is confirmed that the interior of the reaction system is being stirred, the catalyst $Ti(OBu)_4$ (titanium tetrabutoxide, 0.003% by mass based on the total mass of the polycarboxylic acid compounds) is added.

While the resulting water is being distilled off, the temperature is gradually increased to 245° C., and the dehydration condensation reaction is continued to perform a polymerization reaction for 6 hours. The temperature is then decreased to 235° C., and the reaction is continued under a reduced pressure of 30 mmHg for 2 hours to obtain Polyester Resin (A1).

Molecular weight measurement by gel permeation chromatography (GPC) shows that Polyester Resin (A1) thus obtained has a weight average molecular weight of 80,000.

Thermal characteristic measurement with a differential scanning calorimeter shows that the resulting resin has a glass transition temperature Tg of 61° C.

Melting temperature measurement shows that the resulting resin has a melting temperature of 145° C. The melting temperature (flow tester half-fall temperature, Tm) is measured with a CFT-500 Koka-type flow tester (available from Shimadzu Corporation) as the temperature corresponding to half the fall height of a plunger in the range from the flow start point to the flow end point when a 1 $cm^3$ sample is melted and forced to flow through a die orifice with a diameter of 1 mm under a load of 10 kg/cm$^2$ at a heating rate of 3° C./min.

Preparation of Polyester Resin (A2)

Polyester Resin (A2) is prepared by the same procedure as Polyester Resin (A1) except that the contents of the polycarboxylic acid compounds are changed as shown in Table 1 below and no epoxy compound is used. The values shown in Table 1 are the molar equivalents of the effective components of the individual compounds. Polyester Resin (A2) has a weight average molecular weight of 59,000, a Tg of 62° C., and a Tm of 136° C.

Preparation of Polyester Resin (A3)

Polyester Resin (A3) is prepared by the same procedure as Polyester Resin (A1) except that the contents of the polycarboxylic acid compounds are changed as shown in Table 1 below and no epoxy compound is used. The values shown in Table 1 are the molar equivalents of the effective components of the individual compounds. Polyester Resin (A3) has a weight average molecular weight of 59,000, a Tg of 61° C., and a Tm of 133° C.

Preparation of Polyester Resin (A4)

Polyester Resin (A4) is prepared by the same procedure as Polyester Resin (A1) except that the polyol compounds are changed as shown in Table 1 below.

In Table 1, the term "adduct of BPA with 2 mol of EO" refers to an adduct of bisphenol A with 2 mol of ethylene oxide, and the term "adduct of BPA with 2 mol of PO" refers to an adduct of bisphenol A with 2 mol of propylene oxide.

Polyester Resin (A4) has a weight average molecular weight of 60,000, a Tg of 61° C., and a Tm of 137° C.

Preparation of Polyester Resin (A5)

Polyester Resin (A5) is prepared by the same procedure as Polyester Resin (A1) except that the polyol compounds are changed as shown in Table 1 below.

Polyester Resin (A5) has a weight average molecular weight of 56,000, a Tg of 60° C., and a Tm of 133° C.

Preparation of Polyester Resin (A6)

Polyester Resin (A6) is prepared by the same procedure as Polyester Resin (A1) except that the polyol compounds are changed as shown in Table 1 below.

Polyester Resin (A6) has a weight average molecular weight of 57,000, a Tg of 61° C., and a Tm of 134° C.

Preparation of Polyester Resin (A7)

Polyester Resin (A7) is prepared by the same procedure as Polyester Resin (A1) except that the polyol compounds are changed as shown in Table 1 below.

Polyester Resin (A7) has a weight average molecular weight of 58,000, a Tg of 61° C., and a Tm of 135° C.

Preparation of Comparative Polyester Resin (A8)

Polyester Resin (A8) is prepared by the same procedure as Polyester Resin (A1) except that the polyol compounds are changed as shown in Table 1 below.

Polyester Resin (A8) has a weight average molecular weight of 57,000, a Tg of 61° C., and a Tm of 138° C.

TABLE 1

| | | Polyester resin | | | | | | | | | |
|---|---|---|---|---|---|---|---|---|---|---|---|
| | | A1 | A2 | A3 | A4 | A5 | A6 | A7 | A8 | A9 | A10 |
| Polycarboxylic acid | Terephthalic acid | 96 | 98 | 100 | 96 | 96 | 96 | 96 | 96 | 96 | 96 |
| | Sodium 5-sulfoisophthalate | 1 | 2 | 0 | 1 | 1 | 1 | 1 | 1 | 1 | 1 |
| Polyol | Ethylene glycol | 37 | 37 | 37 | 37 | 32 | 28 | 37 | — | 27 | 26 |
| | 1,5-Pentanediol | 63 | 63 | 63 | 62.2 | 61 | 52 | — | — | 45 | 42 |
| | o-Xylylene glycol | — | — | — | — | 7 | 20 | — | — | — | — |
| | Neopentyl glycol | — | — | — | — | — | — | 62.2 | — | — | — |
| | Adduct of BPA with 2 mol of EO | — | — | — | 0.4 | — | — | 0.4 | 34 | 15 | 16 |
| | Adduct of BPA with 2 mol of PO | — | — | — | 0.4 | — | — | 0.4 | 66 | 13 | 16 |
| Epoxy compound | Polyepoxy compound | 3 | — | — | 3 | 3 | 3 | 3 | 3 | 3 | 3 |

Preparation of Toner T1

Preparation of Toner Particles 1

Polyester Resin A1: 89 parts

Ester wax (WEP5 available from NOF Corporation): 2 parts

PP wax (P200 available from Mitsui Chemicals, Inc.): 1 part

Carbon black (Regal 330 available from Cabot Corporation): 7 parts

Charge control agent (BONTRON P-51 available from Orient Chemical Industries Co., Ltd.): 1 part After the above ingredients are premixed in a Henschel mixer, the premixture is mixed in a twin-screw continuous mixer at a feed rate of 15 kg/h and a mixing temperature of 120° C. to obtain a mixture. The mixture is pulverized with an IDS-2 impact-plate pulverizer (available from Nippon Pneumatic Mfg. Co., Ltd.) and is then classified with an Elbow-Jet air classifier (available from MATSUBO Corporation) at a throughput of 1.5 kg/h while the classifying edge position is adjusted to remove fine and coarse particles. Toner Particles 1 are obtained.

Preparation of Toner T1

In a sample mill, 100 parts of Toner Particles 1 thus obtained, 1 part of silica particles having a volume average particle size of 16 nm (R 972 available from Nippon Aerosil Co., Ltd.), and External Additive S1 shown in Table 2 are mixed together at 6,000 rpm for 60 seconds. The mixture is further mixed in a Henschel mixer at a peripheral speed of 20 m/s for 15 minutes and is then passed through a 45 μm mesh sieve to remove coarse particles. Toner T1 is obtained.

Preparation of Toners T2 to T13 and Comparative Toners T1 to T5

Toners T2 to T13 and Comparative Toners T1 to T5 are prepared by the same procedure as Toner T1 except that the type of polyester resin used, the feed rate, the mixing temperature, and the type of external additive are changed as shown in Tables 1 to 3 below.

External Additives S1 to S3 and P1 used for the preparation of Toners T2 to T13 and Comparative Toners T1 to T5 are as follows:

S1: H05TM available from Clariant Japan K.K., volume average particle size=50 nm S2: TG-C190 available from Cabot Corporation, volume average particle size=115 nm S3: H3OTM available from Clariant Japan K.K., volume average particle size=8 nm P1: FS-401 available from Nippon Paint Co., Ltd., volume average particle size=100 nm P2: EPOSTAR S6 available from Nippon Shokubai Co., Ltd., volume average particle size=400 nm Evaluation Methods Evaluation for Cold Offset A modified DocuCentre Color 500 (available from Fuji Xerox Co., Ltd., fixing temperature=120° C., image-forming speed=350 mm/sec), which is an image-forming apparatus that employs two-component contact development, is provided. Each developer is charged into a developing device of the image-forming apparatus and is used to print an image with an image density of 100% and a width of 20 mm in the sheet transport direction on 20 sheets of recording paper (Colotech+ 90 gsm available from Xerox Corporation) in a high-temperature, high-humidity environment (28° C. and 85% RH). The resulting images are evaluated on the following rating scale. The evaluation results are shown in Tables 2 and 3.

Rating Scale

A: completely no problem

B: no image defects are observed by visual inspection, but slight image defects are observed when magnified C: a level at which minor, acceptable image defects are observed by visual inspection D: determined to be unacceptable (unsuitable for practical use) due to image defects Evaluation for Hot Offset A DocuPrint P218 available from Fuji Xerox Co., Ltd., which employs two-component contact development, is provided. A sample image with a print density of 15% (a sample image with an area coverage of 15% that has 1 inch square solid images at the front and rear ends, left and right ends, and center of sheets and characters in the remaining area) is printed on 2,000 sheets of P paper in a high-temperature, high-humidity environment (28° C. and 85% RH). This procedure is repeated to 20 kpv. The resulting images are checked and evaluated for image fogging and hot offset.

Cold offset is evaluated as follows. Immediately after each developer is left standing in a low-temperature, low-humidity environment (10° C. and 15% RH) for 15 minutes, a sample image with a print density of 15% (area coverage of 15%) is printed on 5 sheets of P paper. This procedure is repeated 5 times. The resulting images are checked and evaluated for cold offset.

The following rating scales are used. The evaluation results are shown in Tables 2 and 3.

Rating Scale for Image Fogging

G5 or higher: a level determined to be unacceptable due to image fogging by visual inspection G4: the highest acceptable level at which minor image fogging is observed by visual inspection G3: a level between G2 and G4

G2: a level determined to have no problem by visual inspection

G1: a level determined to have completely no problem by visual inspection

Rating Scale for Hot Offset

G5 or higher: a level determined to be unacceptable due to offset by visual inspection G4: the highest acceptable level at which minor offset is observed by visual inspection G3: a level between G2 and G4

G2: a level determined to have no problem by visual inspection

G1: a level determined to have completely no problem by visual inspection

Rating Scale for Cold Offset

G5 or higher: a level determined to be unacceptable due to offset by visual inspection G4: the highest acceptable level at which minor offset is observed by visual inspection G3: a level between G2 and G4

G2: a level determined to have no problem by visual inspection

G1: a level determined to have completely no problem by visual inspection

TABLE 2

| | Example | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Toner | T1 | T2 | T3 | T4 | T5 | T6 | T7 | T8 | T9 | T10 | T11 | T12 | T13 |
| Resin | A1 | A2 | A3 | A4 | A5 | A6 | A7 | A1 | A1 | A1 | A1 | A1 | A9 |
| Feed rate (kg/h) | 15 | 15 | 15 | 15 | 15 | 15 | 15 | 16 | 14 | 13 | 15 | 15 | 15 |
| Mixing temperature (° C.) | 120 | 120 | 120 | 120 | 120 | 120 | 120 | 110 | 120 | 140 | 120 | 120 | 120 |
| T1/2A − T1/2B | 2.6 | 2.6 | 2.6 | 2.6 | 2.6 | 2.6 | 2.6 | 2 | 5 | 10 | 2.6 | 2.6 | 2 |
| T180/T120 | 0.25 | 0.25 | 0.25 | 0.25 | 0.25 | 0.25 | 0.25 | 0.25 | 0.25 | 0.25 | 0.25 | 0.25 | 0.2 |
| External additive | S1 | S1 | S1 | S1 | S1 | S1 | S1 | S1 | S1 | S1 | S2 | P1 | S1 |
| Particle size of external additive (nm) | 50 | 50 | 50 | 50 | 50 | 50 | 50 | 50 | 50 | 50 | 115 | 100 | 50 |
| Hot offset | G1 | G1 | G1 | G3 | G2 | G2 | G3 | G3 | G2 | G2 | G2 | G2 | G3 |
| Cold offset | G1 | G1 | G2 | G2 | G1 | G1 | G2 | G3 | G2 | G1 | G1 | G1 | G3 |
| Image fogging | G1 | G1 | G1 | G1 | G2 | G2 | G1 | G2 | G2 | G3 | G2 | G1 | G1 |

TABLE 3

| | Comparative Example | | | | | |
|---|---|---|---|---|---|---|
| | 1 | 2 | 3 | 4 | 5 | 6 |
| Toner | Comparative T1 | Comparative T2 | Comparative T3 | Comparative T4 | Comparative T5 | Comparative T6 |
| Resin | A1 | A1 | A1 | A1 | A8 | A10 |
| Feed rate (kg/h) | 18 | 12 | 15 | 15 | 16 | 15 |
| Mixing temperature (° C.) | 100 | 150 | 120 | 120 | 110 | 120 |
| T1/2A − T1/2B | 1.8 | 11 | 2.6 | 2.6 | 1.2 | 1.8 |
| T180/T120 | 0.25 | 0.25 | 0.25 | 0.25 | 0.10 | 0.15 |
| External additive | S1 | S1 | S3 | P2 | S1 | S1 |
| Particle size of external additive (nm) | 50 | 50 | 8.0 | 400 | 50 | 50 |
| Hot offset | G5 | G4 | G1 | G5 | G5 | G5 |
| Cold offset | G1 | G1 | G1 | G2 | G2 | G3 |
| Image fogging determination | G2 | G5 | G5 | G2 | G5 | G4 |

The results shown in Tables 2 and 3 demonstrate that the use of an electrostatic-image developing toner having a difference between T1/2A and T1/2B of 2.0° C. to 10° C. or about 2.0° C. to about 10° C. to form an image in a high-temperature, high-humidity environment may reduce image fogging and offset.

The results also demonstrate that the use of an electrostatic-image developing toner containing toner particles containing a polyester resin that is a polycondensate of at least one polycarboxylic acid compound and at least one polyol compound, including an aliphatic polyol compound in an amount of 70% to 100% by mass or about 70% to about 100% by mass based on the total mass of the at least one polyol compound, to form an image in a high-temperature, high-humidity environment may further reduce image fogging and offset.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

toner particles comprising a polycondensate resin; and hydrophobic external additive particles having a volume average particle size of about 40 to about 200 nm, wherein the electrostatic-image developing toner has a difference between a half-fall temperature T1/2A and a half-fall temperature T1/2B of about 2.0° C. to about 10° C., wherein the half-fall temperature T1/2A is measured with a flow tester after storage in an environment at 50° C. and an absolute humidity of 16.5 g/m$^3$ for 2 hours, and the half-fall temperature T1/2B is measured with a flow tester after storage in an environment at 50° C. and an absolute humidity of 82.7 g/m$^3$ for 2 hours, the polycondensate resin is a polyester resin comprising a polycondensate of at least one polyol compound and at least one polycarboxylic acid compound, wherein the polycarboxylic acid compound comprises a sulfo group or a salt thereof, the toner has a melt viscosity at 120° C. in the range of about $0.5\times10^4$ to about $6.0\times10^4$ Pa·s, and the toner particles are formed by a pulverization process, wherein the temperature during mixing in the pulverization process is in a range of from 110 to 160° C.

2. The electrostatic-image developing toner according to claim 1, wherein the electrostatic-image developing toner has a difference between the half-fall temperature T1/2A and the half-fall temperature T1/2B of about 2.5° C. to about 6.0° C.

3. The electrostatic-image developing toner according to claim 1, wherein the electrostatic-image developing toner has a difference between the half-fall temperature T1/2A and the half-fall temperature T1/2B of about 2.5° C. to about 4.0° C.

4. The electrostatic-image developing toner according to claim 1, wherein the electrostatic-image developing toner has a viscosity at 120° C. of about $0.5\times10^4$ to about $2.2\times10^4$ Pa·s after storage in an environment at 50° C. and an absolute humidity of 82.7 g/m$^3$ for 2 hours.

5. The electrostatic-image developing toner according to claim 1, wherein, the at least one polyol compound comprising an aliphatic polyol compound in an amount of about 70% to about 100% by mass based on the total mass of the at least one polyol compound.

6. The electrostatic-image developing toner according to claim 5, wherein the at least one polyol compound comprises at least one compound selected from the group consisting of ethylene glycol and neopentyl glycol.

7. The electrostatic-image developing toner according to claim 5, wherein the at least one polyol compound further comprises an aromatic diol compound in an amount of greater than 0% to about 30% by mass based on the total mass of the at least one polyol compound.

8. The electrostatic-image developing toner according to claim 7, wherein the aromatic diol compound is an alkylene oxide adduct of bisphenol A.

9. The electrostatic-image developing toner according to claim 5, wherein the polycondensate resin is a polyester resin comprising a polycondensate of the at least one polyol compound, the at least one polycarboxylic acid compound, and at least one polyepoxy compound.

10. The electrostatic-image developing toner according to claim 9, wherein the at least one polyepoxy compound is present in an amount of about 2 to about 15 mole percent based on the total moles of the at least one polyol compound.

11. The electrostatic-image developing toner according to claim 9, wherein the at least one polyol compound comprises at least one compound selected from the group consisting of ethylene glycol and neopentyl glycol.

12. The electrostatic-image developing toner according to claim 1, wherein the hydrophobic external additive particles are silica particles.

13. The electrostatic-image developing toner according to claim 1, wherein the electrostatic-image developing toner has a melt viscosity T120 at 120° C. after storage in an environment at 50° C. and an absolute humidity of 82.7 $g/m^3$ for 2 hours and a melt viscosity T180 at 180° C. after storage in an environment at 50° C. and an absolute humidity of 82.7 $g/m^3$ for 2 hours, the melt viscosities T120 and T180 satisfying about $0.2 \leq (T180/T120) \leq$ about 0.5.

14. An electrostatic image developer comprising the electrostatic-image developing toner according to claim 1.

15. A toner cartridge attachable to and detachable from an image-forming apparatus, the toner cartridge containing the electrostatic-image developing toner according to claim 1.

16. The electrostatic-image developing toner according to claim 1, wherein the polyester resin is a polycondensate of the at least one polycarboxylic acid compound, at least one polyol compound, and at least one polyepoxy compound.

17. The electrostatic-image developing toner according to claim 1, wherein the hydrophobic external additive particles have the volume average particle size of about 40 to about 90 nm.

* * * * *